US006418621B1

(12) United States Patent
Namovich

(10) Patent No.: US 6,418,621 B1
(45) Date of Patent: Jul. 16, 2002

(54) METHOD OF PREPARING A SLEEVE FOR INSTALLATION OF AN AIR CONDITIONING UNIT

(76) Inventor: Richard J. Namovich, 4852 Pimlico Dr., Tallahassee, FL (US) 32308

( * ) Notice: Subject to any disclaimer, the term of this patent is extended or adjusted under 35 U.S.C. 154(b) by 0 days.

(21) Appl. No.: 09/706,542

(22) Filed: Nov. 6, 2000

(51) Int. Cl.[7] ..... B21D 47/00

(52) U.S. Cl. ..... 29/897.312; 29/897.3; 29/525.11

(58) Field of Search ..... 29/897, 897.312, 29/897.3, 428, 525.11; 52/37; 248/208, 209, 236

(56) References Cited

U.S. PATENT DOCUMENTS 2,674,430 A * 4/1954 Galazzi et al.
2,945,358 A * 7/1960 MacLeod et al.
2,946,274 A * 7/1960 Grimes, Jr.
5,112,015 A * 5/1992 Williams

FOREIGN PATENT DOCUMENTS

GB 2070914 * 9/1981

* cited by examiner

*Primary Examiner*—S. Thomas Hughes
*Assistant Examiner*—T. Nguyen
(74) *Attorney, Agent, or Firm*—Peter Loffler

(57) ABSTRACT

A method for preparing a sleeve for installation of an air conditioning unit within the sleeve uses a C-bracket that is positioned about the flange that encompasses the opening of the sleeve. A J-bracket is positioned in abutting relation with the C-bracket and is secured to the flange by either passing a screw through an extension of the J-bracket or by bending an extension of the J-bracket to the C-bracket. The air conditioning unit is positioned such that its securement flange abuts the C-bracket/J-bracket combination and is secured thereto.

4 Claims, 6 Drawing Sheets

METHOD OF PREPARING A SLEEVE FOR INSTALLATION OF AN AIR CONDITIONING UNIT

BACKGROUND OF THE INVENTION

1. Field of the Invention

The present invention relates to a method for preparing a sleeve such that an air conditioning unit can be safely installed and secured within the sleeve.

2. Background of the Prior Art

Living quarters within a commercial setting, such as a hotel room, a hospital room, a nursing home room, etc., each tend to have separate air conditioning units for controlling the environment within the particular room. Many such air conditioning units are held within a sleeve so that the outer portion of the air conditioning unit is disposed outside of the building wherein the room is located in order to draw working air for the unit, and another portion of the air conditioning unit is disposed within the room so as to control the atmosphere therein. The sleeve is an integral part of the building and is secured thereto. The sleeve has a sleeve wall and a flange, the flange having a front surface, a rear surface, an inner wall, and an outer wall. The sleeve flange can be somewhat flush with the interior wall of the room or can extend outwardly therefrom.

In a new construction building, this system works well such that the securement flange of the air conditioning unit abuts the flange of the sleeve and the securement flange is secured thereto. However, the air conditioning unit must be serviced at regular intervals. In order to service the air conditioning unit, the securement flange of the air conditioning unit is detached from the flange of the sleeve, the air conditioning unit is serviced, and the unit is then placed back within the sleeve and the securement flange of the air conditioning unit is resecured to the flange of the sleeve. While the securement flange of the air conditioning unit is made from a sturdy material that stands up well during repeated unit servicing, the flange of the sleeve deteriorates with repeated servicing of the air conditioning unit. This deterioration of the flange sleeve requires that the owner replace the sleeve at substantial cost to the owner. Alternately, the owner can ignore the problem and can place the air conditioning unit within the sleeve and secure the air conditioning unit therein in less than ideal fashion. Such an air conditioning unit securement can cause the air conditioning unit to become dislodged if a person places weight onto the air conditioning unit resulting in injury to the person or damage to the air conditioning unit, both undesirable results.

Therefore, there is a need in the art for a method to secure an air conditioning unit within the sleeve of a building irrespective of the fact that the sleeve has deteriorated. Such a method must be relatively simple and straightforward to implement. The method must allow the air conditioning unit to be secure enough so that a person placing weight onto an air conditioning unit secured using the present method does not dislodge the unit from within the sleeve. The method must accommodate air conditioning unit installations wherein the flange of the sleeve is somewhat flush with an interior wall of the room and as well as wherein the flange of the sleeve extends outwardly from the wall.

SUMMARY OF THE INVENTION

The method for preparing a sleeve for installation of an air conditioning unit of the present invention addresses the aforementioned needs in the art. The method allows an air conditioning unit to be secured within the sleeve of a building even if the flange of the sleeve has deteriorated. The method is relatively simple and straightforward to implement. The method works equally with sleeves that have a flange that is somewhat flush with an interior wall of the room having the sleeve, as well as a room wherein the flange extends outwardly from the wall.

The method for preparing a sleeve for installation of an air conditioning unit of the present invention is comprised of the steps of providing a C-bracket having a first leg, a second leg and a connecting leg connecting the first leg with the second leg. The C-bracket is positioned about the side of the flange such that the first leg abuts the front surface of the flange, and the second leg abuts the rear surface of the flange. A J-bracket having a first extension, a second extension and a joining extension joining the first extension with the second extension is provided. The J-bracket is positioned about the C-bracket such that the first extension of the J-bracket abuts the connecting leg of the C-bracket and the second extension of the J-bracket abuts the outer wall of the flange and is secured to the flange. The first leg of the C-bracket is longer than the second leg. The second extension of the J-bracket is longer than the first extension. The J-bracket is secured to the flange by passing a screw through the second extension and through the flange. Alternately, the J-bracket is positioned against the sleeve wall such that the second extension abuts the sleeve wall and the joining extension abuts the second leg and the J-bracket is secured to the flange by passing a screw through the second extension and through the sleeve wall. As a further alternative, the J-bracket is positioned about the C-bracket such that the second extension abuts the connecting leg and the first extension abuts the outer wall and the second extension is bent toward the second leg in order to provide frictional securement.

BRIEF DESCRIPTION OF THE DRAWINGS

Similar reference numerals refer to similar parts throughout the several views of the drawings.

DESCRIPTION OF THE PREFERRED EMBODIMENT

Figure 2:
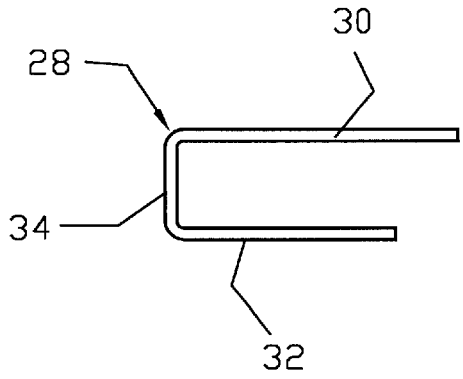
FIG. 2 is an view of the C-bracket.
Figure 1:
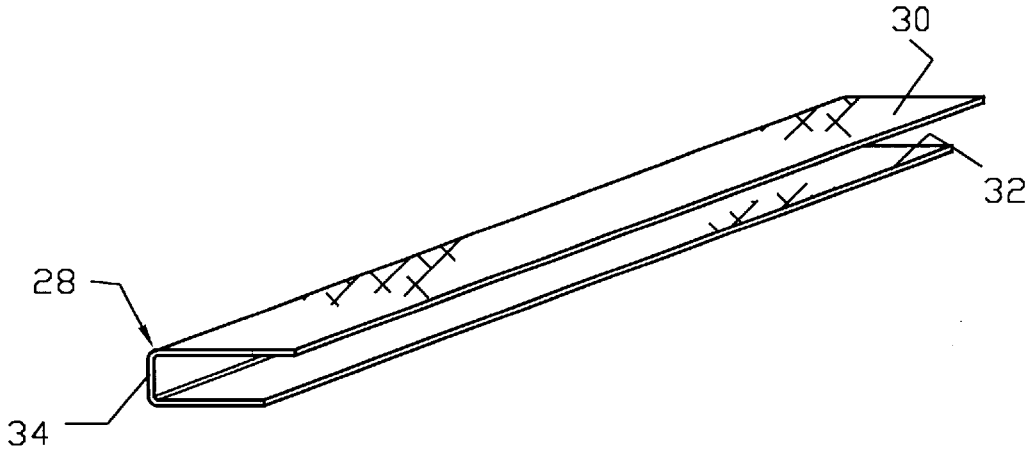
FIG. 1 is a perspective view of the C-bracket used with the method for preparing a sleeve for installation of an air conditioning unit of the present invention.
Figure 4:
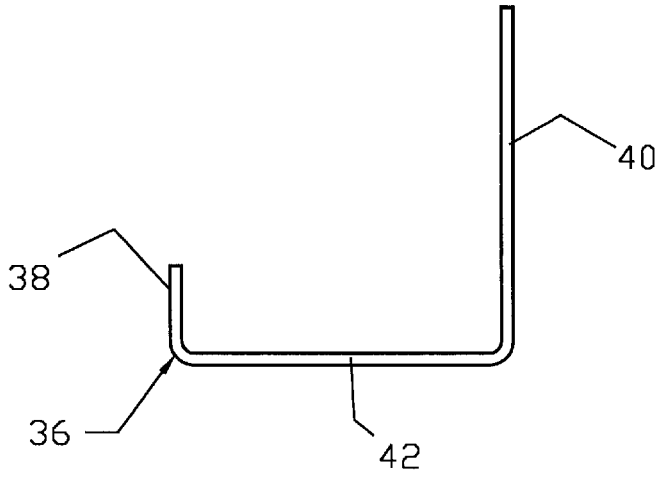
FIG. 4 is an end view of the J-bracket.
Figure 3:
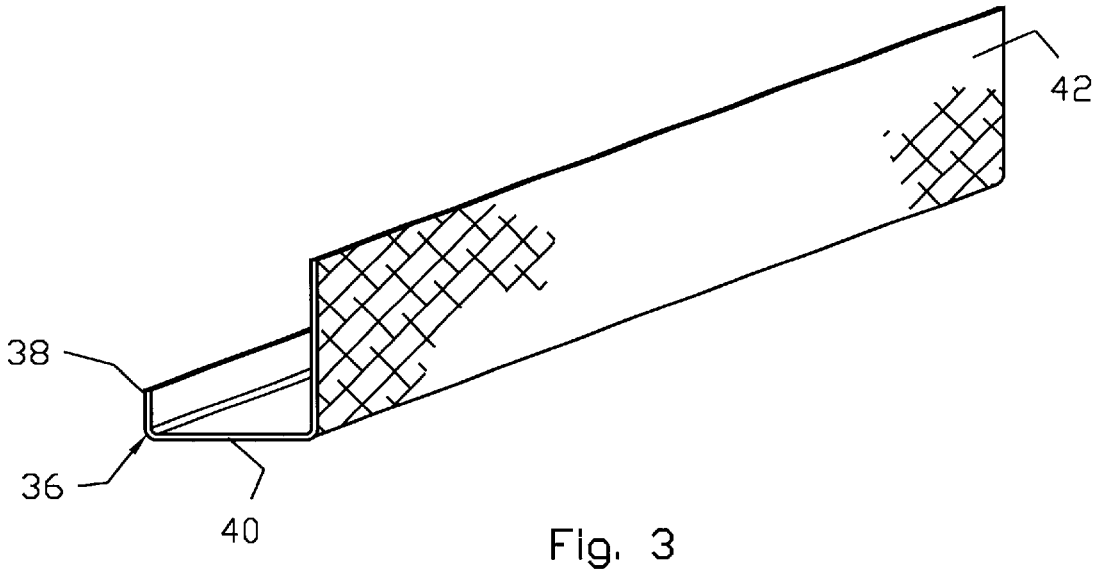
FIG. 3 is a perspective view of the J-bracket used with the method for preparing a sleeve for installation of an air conditioning unit of the present invention.
Figure 5:
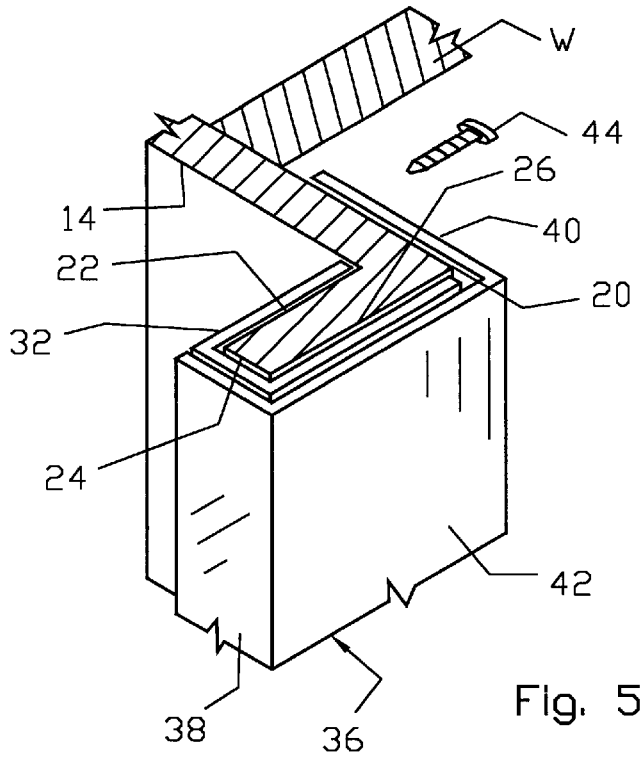
FIG. 5 is a perspective view of the C-bracket and the J-bracket secured to a sleeve.
Figure 6:
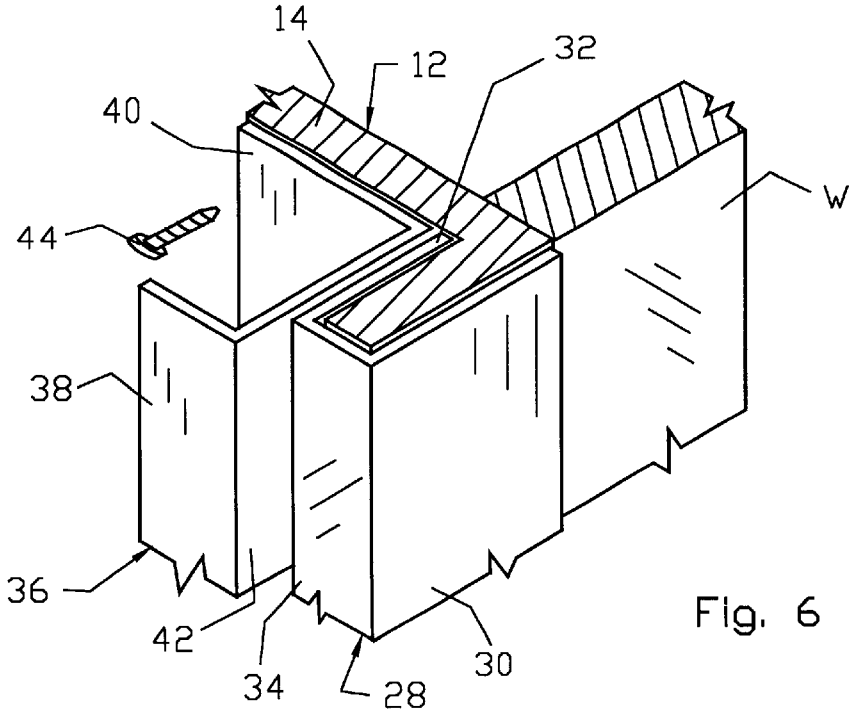
FIG. 6 is a perspective view of the C-bracket and the J-bracket secured to a sleeve in an alternate fashion.
Figure 7A:
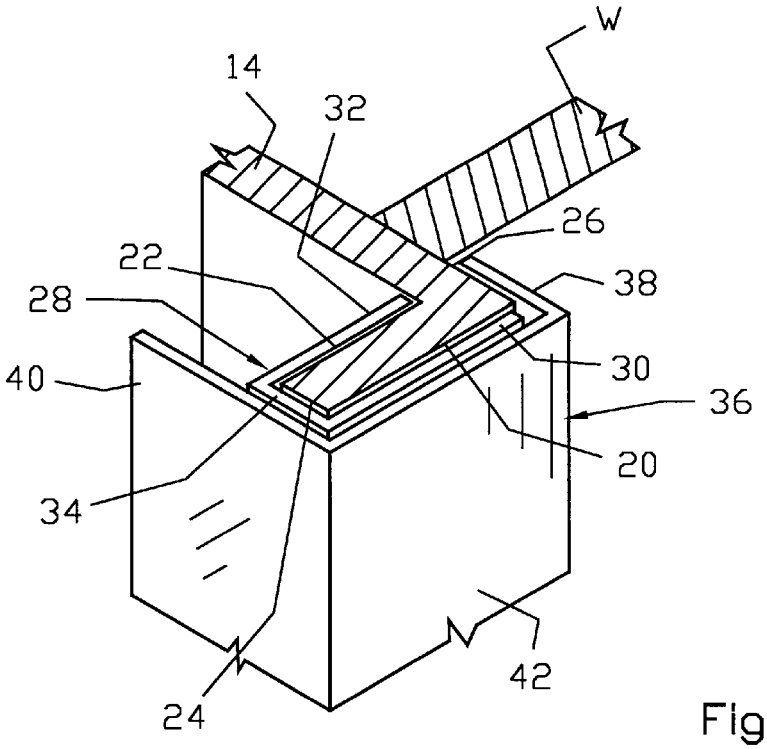
FIG. 7*a* is a perspective view of the C-bracket and the J-bracket secured to a sleeve in a second alternate fashion prior to final securement.
Figure 7B:
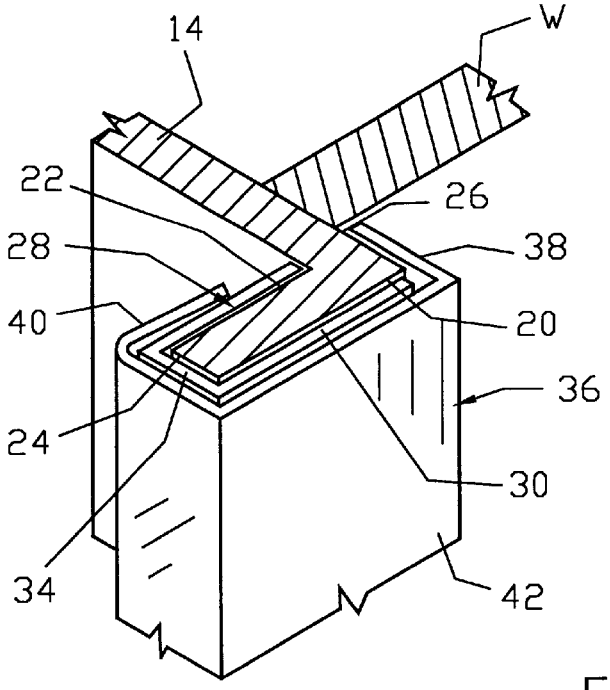
FIG. 7*b* is a perspective view of the C-bracket and the J-bracket secured to a sleeve in a second alternate fashion upon to final securement
Figure 8:
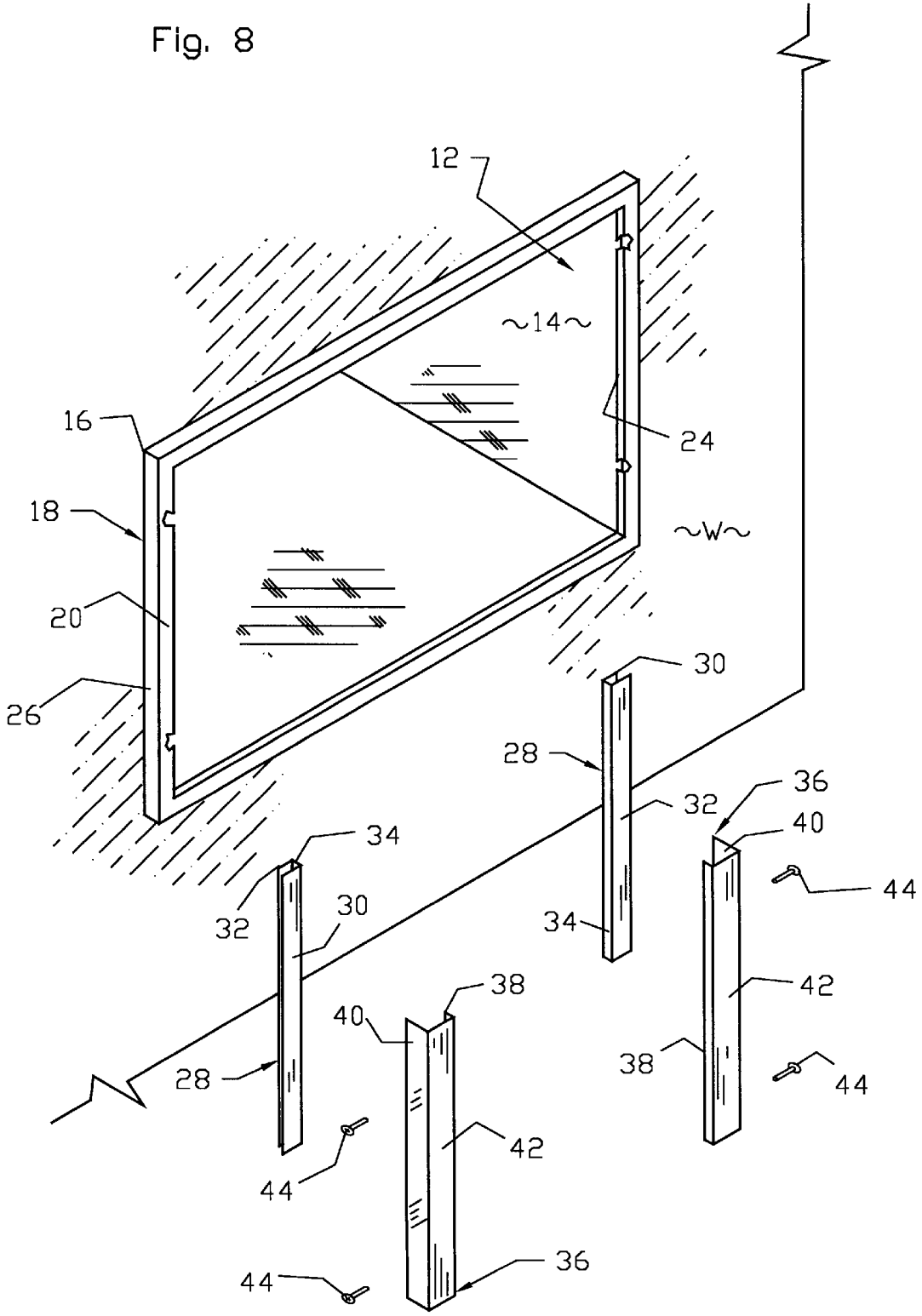
FIG. 8 is an exploded view of the C-bracket, the J-bracket, and the sleeve.
Figure 9:
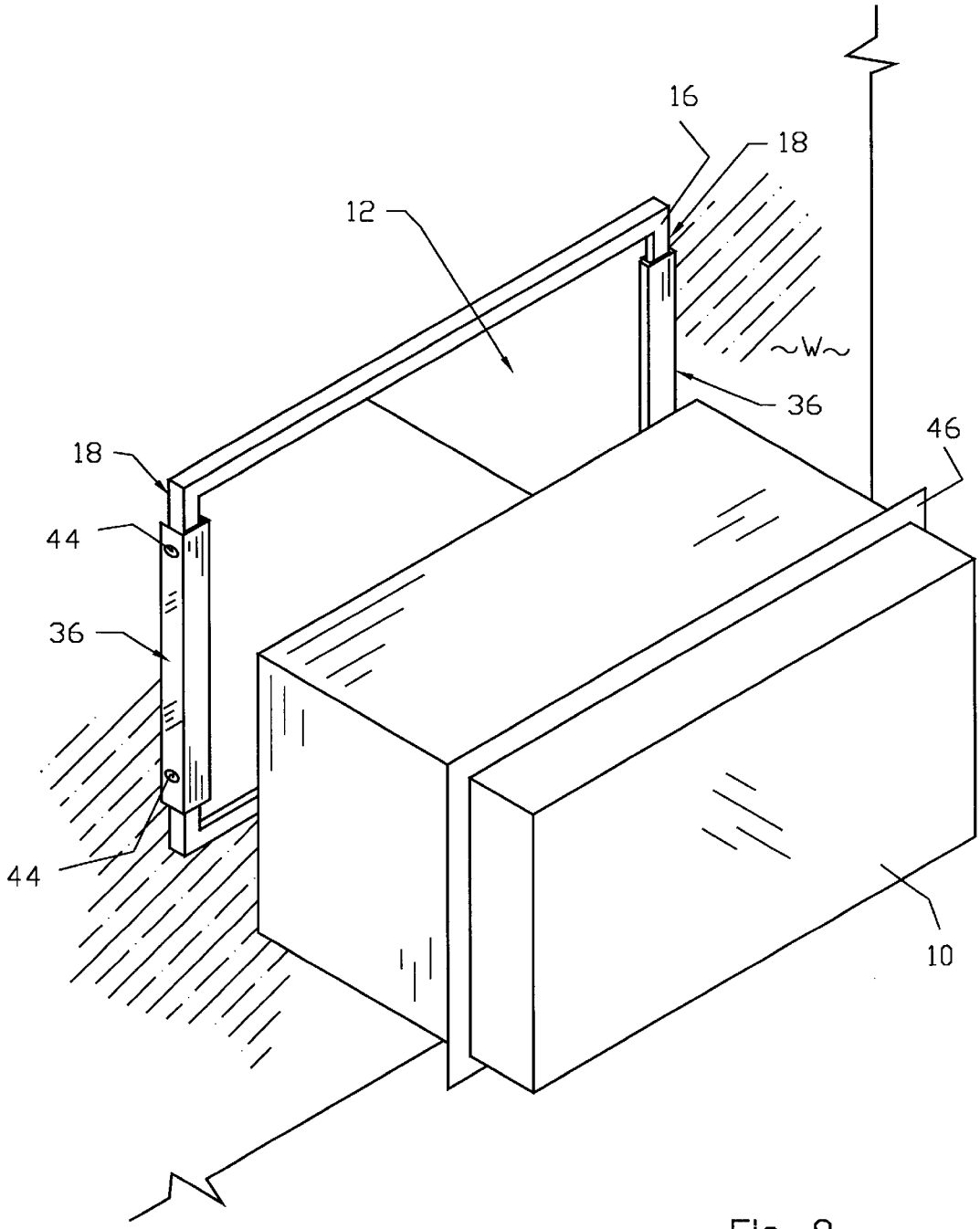
FIG. 9 is an environmental view of an air conditioning unit ready for securement within the sleeve, the sleeve prepared by the method of the present invention.

Referring now to the drawings, it is seen that the method for preparing a sleeve for installation of an air conditioning unit 10 of the present invention, the sleeve 12 having a sleeve wall 14 and a flange 16, the flange 16 having a pair of sides 18 each having a front surface 20, a rear surface 22, an inner wall 24, and an outer wall 26, the method being comprised of the steps of providing a C-bracket 28 having a first leg 30, a second leg 32 and a connecting leg 34 connecting the first leg 30 with the second leg 32. The C-bracket 28 is made from any sturdy material such as plastic or metal. The C-bracket 28 is positioned so about one side of the flange 16 such that the first leg 30 of the C-bracket 28 abuts the front surface 20 of the flange 16, and the second leg 32 abuts the rear surface 22 of the flange 16. In this position, the connecting leg 34 of the C-bracket 28 abuts the inner wall 24 of the side 18 of the flange 16. The first leg 30 of the C-bracket 28 is longer than the second leg 32.

A J-bracket 36, having a first extension 38, a second extension 40, and a joining extension 42 joining the first extension 38 with the second extension 40, is provided. The J-bracket 36 is made from any sturdy material such as plastic or metal. The second extension 40 of the J-bracket 36 is longer than the first extension 38. The J-bracket 36 is positioned about the C-bracket 28 such that the first extension 38 of the J-bracket 36 abuts the connecting leg 34 of the C-bracket 28 and the second extension 40 abuts the outer wall 26 of the flange 16 and is secured to the flange 16. In this position, the joining extension 42 of the J-bracket 36 abuts the first leg 30 of the C-bracket 28. The J-bracket 38 is secured to the flange 16 by passing a screw 44 through the second extension 40 and through the flange 16. This secures both the J-bracket 36 and the C-bracket 28 about the portion of the flange 16 to which the two 28 and 36 are secured.

Alternately, if the flange 16 of the sleeve 12 is somewhat flush with the interior wall W of the room wherein the sleeve 12 is located, the J-bracket 36 is positioned against the sleeve wall 14 such that the second extension 40 of the J-bracket 36 abuts the sleeve wall 14 and the joining extension 42 abuts the second leg 32 of the C-bracket 28 and the J-bracket 36 is secured to the flange 16 by passing a screw 44 through the second extension 40 and through the sleeve wall 14.

As a further alternative, the J-bracket 36 is positioned about the C-bracket 28 such that the second extension 40 of the J-bracket 36 abuts the connecting leg 34 of the C-bracket 28 and the first extension 38 abuts the outer wall 26 of the flange 16. Once so positioned, the second extension 40 of the J-bracket 36 is bent toward the second leg 32 of the C-bracket 28. By bending the second extension 40 of the J-bracket 36 toward the second leg 32 of the C-bracket 28, the J-bracket 36 as well as the C-bracket 28 are secure against the flange 16.

The opposing side 18 of the flange 16 is prepared in substantially similar fashion to the preparation of the first side 18 as described above.

Once each side 28 of the flange 16 of the sleeve 12 is appropriately prepared with the C-bracket 28 and the J-bracket 36 attached, the air conditioning unit 10 is positioned within the sleeve 12 such that the securement flange 46 of the air conditioning unit 10 abuts the two prepared sides of the sleeve 12, and the securement flange 46 is secured to the two prepared sides in appropriate fashion.

While the invention has been particularly shown and described with reference to an embodiment thereof, it will be appreciated by those skilled in the art that various changes in form and detail may be made without departing from the spirit and scope of the invention.

I claim:

1. A method of preparing a sleeve for installation of an air conditioning unit within a sleeve, the sleeve having a sleeve wall with a flange extending about the sleeve wall's periphery, the flange having a side with a front surface, a rear surface, an inner wall and an outer wall, the method comprising the steps of:

providing a C-bracket having a first leg, a second leg and a connecting leg connecting the first leg with the second leg;

positioning the C-bracket about the side of the flange such that the first leg abuts the front surface, and the second leg abuts the rear surface;

providing a J-bracket having a first extension, a second extension and a joining extension joining the first extension with the second extension;

positioning the J-bracket about the C-bracket such that the first extension abuts the connecting leg and the second extension abuts the outer wall; and securing the J-bracket to the flange.

2. The method as in claim 1 wherein the first leg is longer than the second leg.

3. The method as in claim 1 wherein the second extension is longer than the first extension.

4. The method as in claim 1 wherein the J-bracket is secured to the flange by passing a screw through the second extension and through the flange.

* * * * *